US010350655B2

(12) United States Patent
Miranda

(10) Patent No.: US 10,350,655 B2
(45) Date of Patent: Jul. 16, 2019

(54) UNIVERSAL GLASS PIPE CLEANER

(71) Applicant: Douglas Miranda, Port Angeles, WA (US)

(72) Inventor: Douglas Miranda, Port Angeles, WA (US)

( * ) Notice: Subject to any disclaimer, the term of this patent is extended or adjusted under 35 U.S.C. 154(b) by 193 days.

(21) Appl. No.: 15/657,095

(22) Filed: Jul. 21, 2017

(65) Prior Publication Data

US 2018/0021823 A1 Jan. 25, 2018

Related U.S. Application Data

(60) Provisional application No. 62/364,985, filed on Jul. 21, 2016.

(51) Int. Cl.

| | |
|---|---|
| ***B08B 9/032*** | (2006.01) |
| ***A24F 1/30*** | (2006.01) |
| ***B08B 9/00*** | (2006.01) |
| ***B08B 17/02*** | (2006.01) |

(52) U.S. Cl.

CPC ..... *B08B 9/0321* (2013.01); *A24F 1/30* (2013.01); *B08B 9/00* (2013.01); *B08B 17/025* (2013.01)

(58) Field of Classification Search

None

See application file for complete search history.

(56) References Cited

U.S. PATENT DOCUMENTS

| | | | |
|---|---|---|---|
| 2,508,827 | A | 5/1950 | Holden |
| 3,856,024 | A | 12/1974 | Lamberti |
| 3,950,830 | A | 4/1976 | Duprez |
| 4,428,433 | A | 6/1984 | Watkins |
| 4,743,260 | A | 5/1988 | Burton |
| 5,768,741 | A | 6/1998 | Leiman |
| 7,001,081 | B2 | 2/2006 | Cox et al. |
| 7,356,870 | B2 | 4/2008 | VanHulzen |
| 7,677,812 | B2 | 3/2010 | Costagna et al. |
| 9,535,230 | B2 | 1/2017 | Newbury et al. |
| 2009/0019680 | A1 | 1/2009 | Krohn |
| 2015/0164136 | A1 | 6/2015 | Gammel |

FOREIGN PATENT DOCUMENTS

| | | |
|---|---|---|
| CA | 2271404 | 9/2008 |

*Primary Examiner* — Rita P Adhlakha

(74) *Attorney, Agent, or Firm* — Elizabeth Reilly; Patentpending, PLLC

(57) ABSTRACT

A glass pipe cleaner comprising, in operative combination, a threaded reducer, a staged telescopic boot, an end clamp, and a worm drive clamp. The threaded reducer is configured for mounting onto a conventional water faucet. Once mounted, a user inserts a mouth end portion of a glass pipe, into the staged telescopic boot and cinches the mouth end portion in position by tightening the worm drive clamp over an exterior of the staged telescopic boot. In operation, hot water is pressurized by the threaded reducer and floods an intermediary tube of the glass pipe with extreme force. The force of the pressurized hot water removes deposits from walls of the intermediary tube of the glass pipe. Dirty water carrying the removed deposits flows out of a second end of the glass pipe into a sink for easy disposal. In another embodiment, the glass pipe cleaner includes a waste bag.

6 Claims, 5 Drawing Sheets

UNIVERSAL GLASS PIPE CLEANER

FIELD OF THE INVENTION

The subject matter of the disclosure relates to a device and system for cleaning the interior wall surfaces of glass pipes including water pipes. A universal glass pipe cleaning device of the present disclosure is capable of penetrating and removing accumulated deposits; scouring the interior wall surfaces of glass pipes or water pipes to remove the accumulation of deposits on the interior wall surfaces; and discarding the removed deposits and residue into a receptacle. The universal glass pipe cleaning device relates to a device for use with a conventional water faucet. The universal glass pipe cleaning device comprises threaded reducer, a staged telescopic boot, a worm drive clamp having a locking screw, and an end clamp. The universal glass pipe cleaning device provides a device to elutriate glass marijuana smoking pipes lined with oily creosote and smoke particulate deposits. The device permits for safe and efficient removal of the deposits from any sized glass pipe or water pipe using a pressure source being a pressurized hot water source coupled to the staged telescopic boot as the abluent.

BACKGROUND OF THE INVENTION

A popular method for ingesting marijuana is through smoking marijuana via glass pipes. The glass pipes are shaped at a first end for insertion within a user's mouth, and are shaped at a second end for burning marijuana. An intermediary tube transmits smoke produced at the second end to the first end of the pipe for inhalation by the user.

As the smoke travels through the intermediary tube, oils—akin to creosote—are released into the air inside the intermediary tube. These creosote oils stick to the interior surface of the intermediary tube. Over time, the interior surfaces of the walls of the intermediary tube collect layers of creosote oily deposits, residue, debris, and other smoke particulate deposits. These creosote oily deposits, and other residues, carry an undesirable scent and are visually displeasing.

As a result, a user must periodically clean the interior surface of the walls of the intermediary tube of the glass pipe. Typical prior art methods for conducting this cleaning involve the use of manually inserted pipe cleaners and/or through the use of strong chemical cleaners, such as strong bases, bleach, strong acids, in which the pipe is soaked and then rinsed. These methods tend to remove a few layers of the deposits, but rarely render the pipe fully clean or clear. Such strong chemical cleaners can cause corrosive damage to pipes or result in sever injury if they come in contact with exposed portions of the human body, or if they are ingested. Such chemical cleaners are particularly dangerous in households with young children. Pressurized fluid methods can, also, result in the splashing of liquids on the operator, especially, the operator's eyes, thereby, causing bodily harm to the operator. In addition, the strong chemical cleaners, typically, used are hazardous to the user and the environment.

Accordingly, there is an as yet unmet need in the art for a universal glass pipe cleaner that (1) does not require the use of manually inserted pipe cleaners and/or strong chemicals to clean, clear, and remove deposits; (2) is safe, efficient and economically affordable; and (3) effectively cleans glass pipes of all sizes.

SUMMARY OF THE INVENTION

The disclosure of the subject matter of the glass pipe cleaner is directed to a device and system for cleaning the interior surfaces of the walls of glass pipes including water pipes. The glass pipe cleaner embodiment of the present disclosure comprises a threaded reducer, a staged telescopic boot, a worm drive clamp having a locking screw, and an end clamp. The glass pipe cleaner is enabling and operable to elutriate marijuana smoking glass pipes lined with oily creosote and smoke particulate deposits; and water pipes. The glass pipe cleaner permits for safe and efficient removal of the deposits, debris, and oily creosote residue from any sized glass pipe or water pipe using a pressure source being a pressurized hot water source coupled to the staged telescopic boot as the abluent.

More particularly, the glass pipe cleaner includes a threaded reducer which is configured for mounting onto a conventional water faucet head by engagement of opposed threaded ends. In general, the staged telescopic boot is coupled to the conventional water faucet by means of the threaded reducer whereby a user inserts a mouth end opening of a glass pipe until the mouth end opening of the glass pipe bears against a stopping member configured within the staged telescopic boot. The user then cinches and secures a portion of the glass pipe in position within the staged telescopic boot by means of rotating and tightening the worm drive clamp over the outside of the staged telescopic boot by means of rotating and tightening of the locking screw.

Further, in operation, a user turns on hot water to run through the faucet attached to a sink or receptacle. The hot water is pressurized by the threaded reducer and travels under pressure through the staged telescopic boot to flood the intermediary tube of the glass pipe with extreme force for enabling and operatively scrubbing, and removing the oily creosote deposits, other smoke deposits, debris, and residue. The extreme force of the pressurized hot water is of a strength enabling and operable to remove deposits from the interior walls of the intermediary tube of the glass pipe. The dirty water flows carrying the removed deposits and debris out of a second end of the glass pipe and into the user's sink for easy disposal.

In another embodiment of the universal glass pipe cleaning device, a disposable waste bag is implemented with the universal glass pipe cleaning device for the recovery and disposal of the removed debris and waste.

BRIEF DESCRIPTION OF THE DRAWINGS

Reference will now be made in detail to embodiments, examples of which are illustrated in the accompanying drawings. When convenient, the same reference numbers are use throughout the drawings to refer to the same or like parts.

Figure 1:
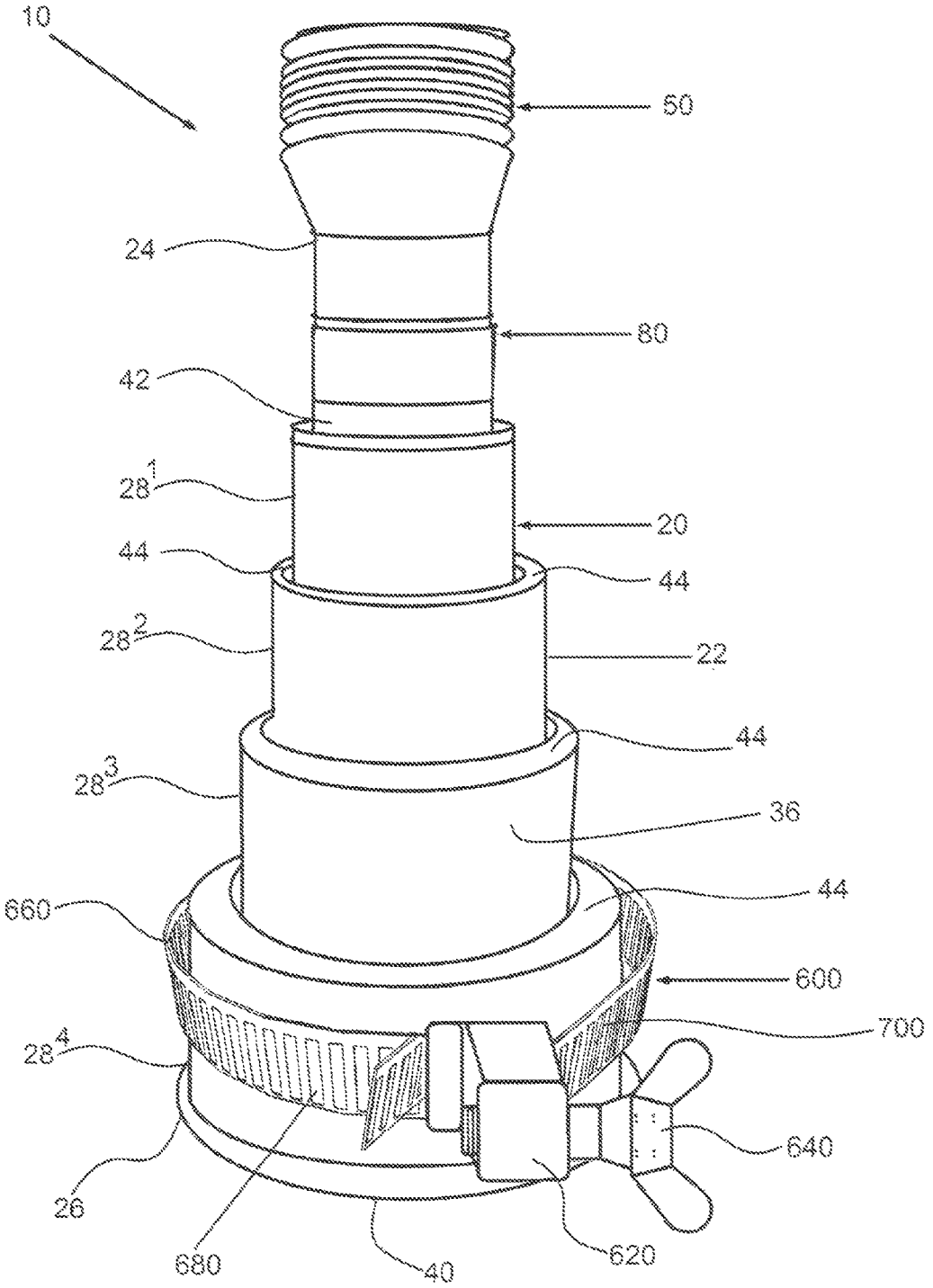
FIG. 1 is a perspective view of a glass pipe cleaner including a threaded reducer; a staged telescopic boot; an end clamp; and a worm drive clamp having a locking screw, in accordance with an embodiment of the disclosure.

In the following description of the illustrated embodiments, reference is made to the accompanying drawings, in which is shown by way of illustration, various embodiments in which the disclosure may be practiced. It is to be understood that the embodiments may be utilized and structural changes may be made without departing from the scope of the present disclosure. Like numbers used in the figures refer to like components. However, it will be understood that the use of a number to refer to a component in a given figure is not intended to limit the component in another figure labeled with the same number.

DETAILED DESCRIPTION

The need remains for an efficient universal glass pipe cleaning device that can be used to mitigate and thoroughly clean the interior walls of a glass pipe, and their intermediary tubes therein, of a variety of glass pipes of different sizes having a variety of cross-sectional diameters. This glass pipe cleaner should be lightweight, readily handled in home processes, and have efficiency in cleaning characteristics that are appropriate to the frequency of use for a particular glass pipe of various sizes having varying diameters. Disclosed herein is a universal glass pipe cleaning device, a glass pipe cleaner, for use with a water faucet useful for scraping and discarding of deposits on the interior surfaces of walls of a glass pipe and its intermediary tube. The glass pipe cleaner, further including a flexible hose, also, is used to clean water pipes.

A glass pipe cleaner 10 will now be described in detail with reference to FIGS. 1-5. With reference to FIGS. 1-5, the glass pipe cleaner 10 for introducing pressurized hot water from a water faucet into a glass pipe 100 to clean the glass pipe 100, the glass pipe cleaner 10 comprises, a threaded reducer 50; a staged telescopic boot 20; an end clamp 80. In general, the glass pipe cleaner 10 is used to remove and discard oily creosote deposits and smoke particulate accumulated on surfaces of interior walls of the glass pipe 100 and the interior surfaces of the walls of its intermediary tube 108. The number of stages of the staged telescopic boot 20 allows for a variety of sizes of glass pipes 100 to be inserted and secured therein the glass pipe cleaner 10 and thereby the staged telescopic boot 20 provides a universal glass pipe cleaning device.

Figure 2:
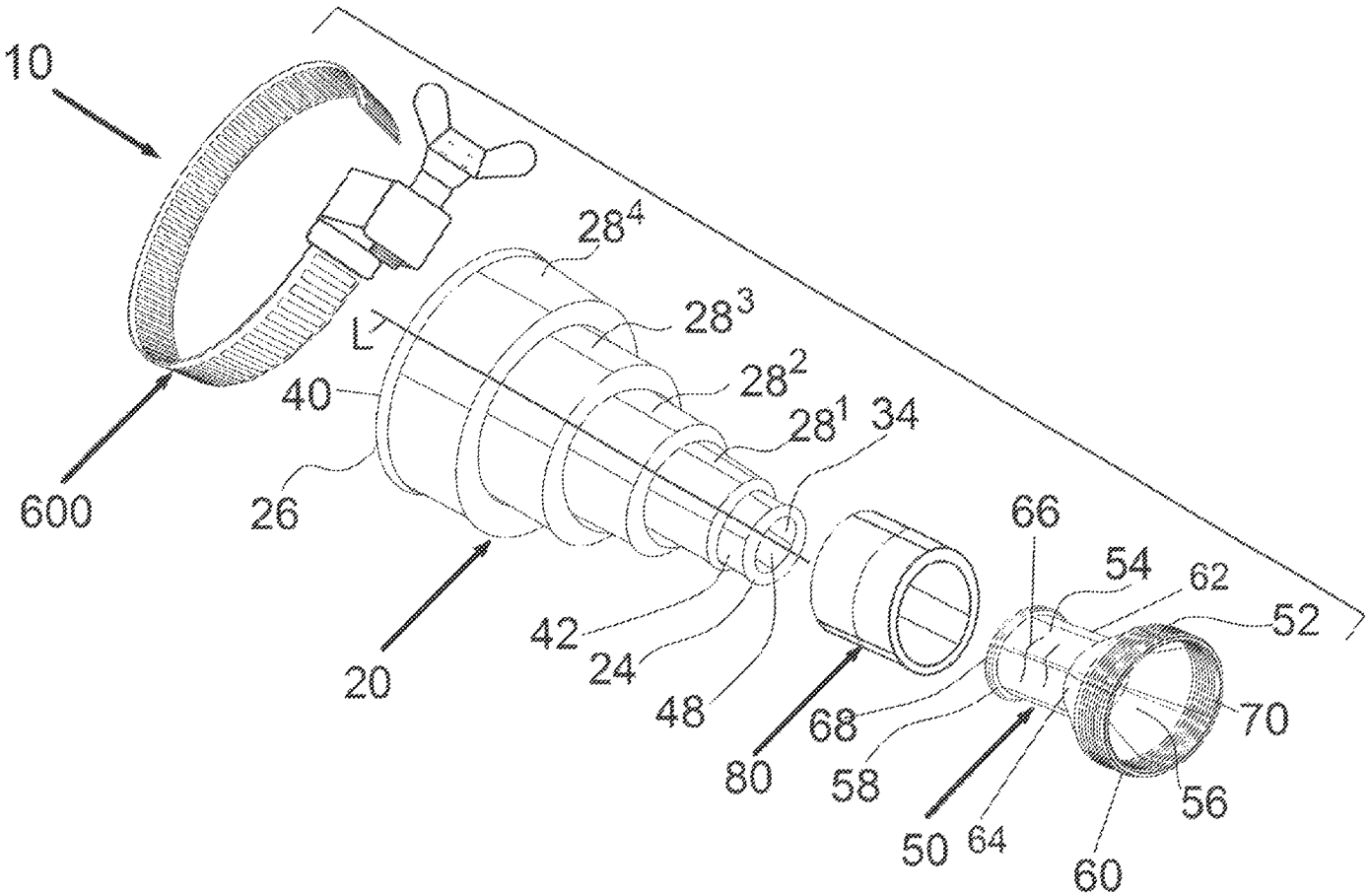
FIG. 2 is an isometric exploded view of the glass pipe cleaner of FIG. 1, including the threaded clamp; the staged telescopic boot, the end clamp, and the worm drive clamp; in accordance with an embodiment of the disclosure.
Figure 5:
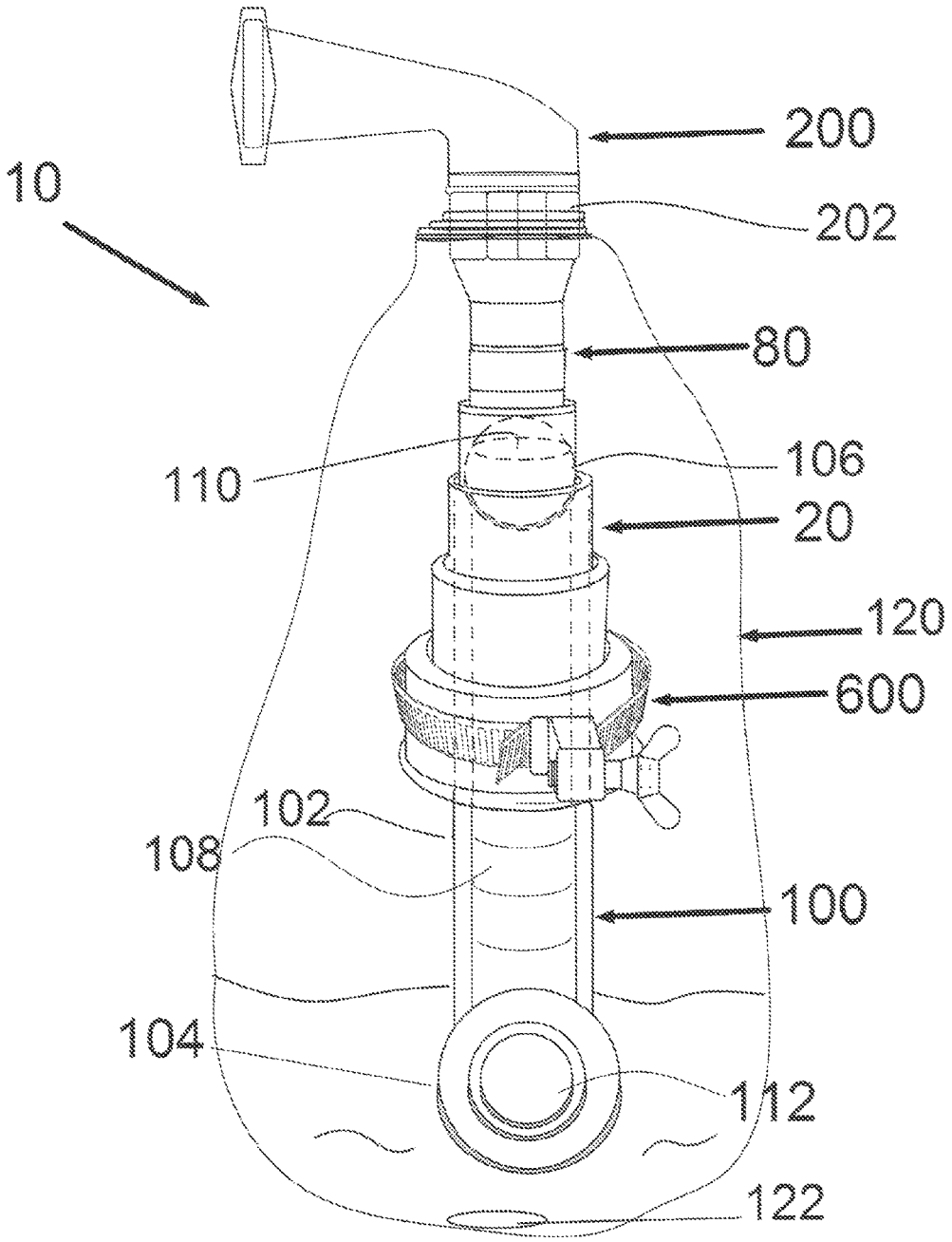
FIG. 5 is a plan view of the glass pipe cleaner in use, the glass pipe cleaner mounted to a water faucet and a glass pipe inserted therein the staged telescopic boot thereof the glass pipe cleaner, implemented with a waste bag, in accordance with an embodiment of the disclosure.

With particular reference to FIG. 2 and FIG. 5, the threaded reducer 50 of the glass pipe cleaner 10 is configured for mounting the glass pipe cleaner 10 onto a water faucet 200 head 202 providing fluidly connecting a mouth of the water faucet 200 to the glass pipe cleaner 10 so that a flow of pressurized hot water reaches the an interior surface of the glass pipe 100 to be cleaned.

The threaded reducer 50 includes integrally machined threads that are configured to be opposed to integrally machined threads of the water faucet 200 head 202 such that when the threaded reducer 50 is inserted into a threaded mouth of the water faucet 200 head 202 the threaded reducer 50 and the water faucet 200 head 202 become removably attached to each other upon rotating and thereby tightening the threaded reducer 50 engaged with the threaded mouth of the water faucet 200 head 202. Thereby, the threaded reducer 50 is operative and enabling for mounting the glass pipe cleaner 10 onto the conventional water faucet 200 to provide the pressurized hot water source during the operation of cleaning the glass pipe 100.

With reference to FIGS. 1 and 2 the threaded reducer 50 of the glass pipe cleaner 10 includes a sleeve nut portion 52 and a reducer stem 54, the reducer stem 54 is integrally machined extending downward from the sleeve nut portion 52 wherein the threaded reducer 50 includes a central opening 56 limited by a first open end and a second open end causing the threaded reducer 50 to include an annular hollow interior. The first open end is a connector faucet end 60 having an annular connector faucet end opening 70 and the second open end is a connector boot end 58 having an annular connector boot end opening 68.

The sleeve nut portion 52 includes integrally machined interior threads disposed on an interior surface of the connector faucet end 60 and integrally machined exterior threads disposed on an exterior surface of an annular sleeve 62 of the connector faucet end 60. The sleeve nut portion 52 includes both integrally machined interior threads integrally machined disposed on the interior surface of the connector faucet end 60 and integrally machined exterior threads disposed on the exterior surface of the annular sleeve 62 to provide use of the glass pipe cleaner 10 with a variety of water faucets 200 found conventionally in homes.

In operation, the glass pipe cleaner 10 is removably attached to the water faucet 200 by means of the sleeve nut portion 52 of the threaded reducer 50 which is removably attached to the water faucet 200 by engaging the interior threads of the connector faucet end 60 with the exterior threads of the water faucet 200, wherein the water faucet 200 comprises exterior threads.

In an alternative embodiment, the sleeve nut portion 52 of the threaded reducer 50 is removably attached to the water faucet 200 by engaging the exterior threads of the annular sleeve 62 of the connector faucet end 60 with the interior threads of the water faucet 200, wherein the water faucet 200 comprises interior threads.

Figure 4:
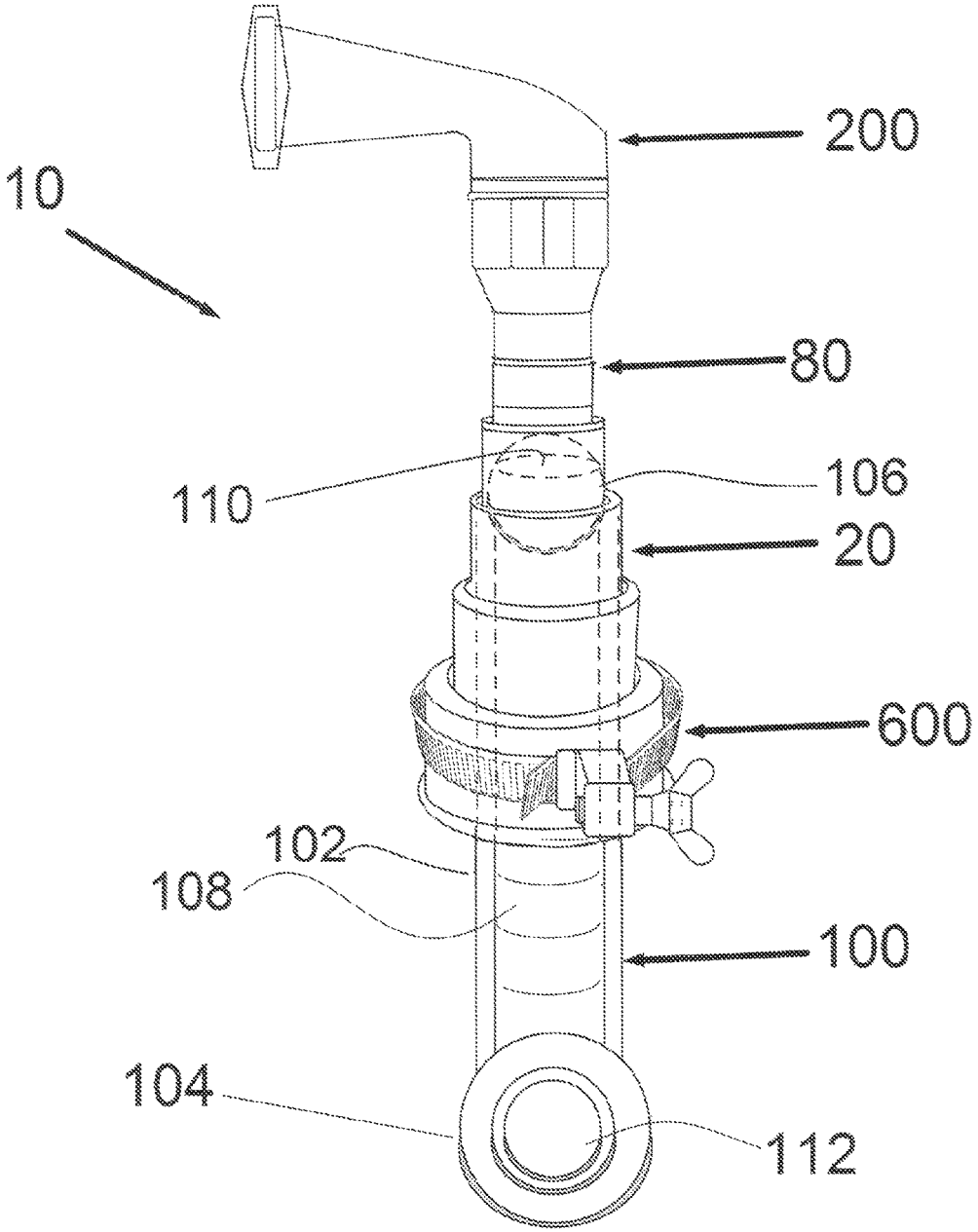
FIG. 4 is a perspective view of the glass pipe cleaner in use, the glass pipe cleaner mounted to a water faucet and a glass pipe inserted therein the staged telescopic boot thereof the glass pipe cleaner, in accordance with an embodiment of the disclosure.

The threaded reducer 50 includes an annular shoulder 64 formed at the upper end of the reducer stem 54 and the lower end of the sleeve nut portion 52 of the threaded reducer 50. The reducer stem 54 has a corrugated portion of which is inserted within a first opening of the staged telescopic boot 20, an annular connector mounting opening 34 at a connector mounting end 24 of the staged telescopic boot 20 to secure the threaded reducer 50 to the staged telescopic boot for enabling and operatively coupling the staged telescopic boot 20 to the water faucet 200, as shown in FIGS. 4 and 5.

The threaded reducer 50 may be manufactured with chrome, metal, stainless steel.

With reference to FIGS. 1-2, the staged telescopic boot 20 includes the connector mounting end 24 including an annular connector mounting opening 34 disposed at the upper end 36 of the staged telescopic boot 20. A collar 42 is formed proximate to a circumferential rim 46 of the annular connector mounting opening 34 of the connector mounting end 24 of the staged telescopic boot 20. In practicing the glass pipe cleaner 10, the reducer stem 24 of the threaded reducer 20 is inserted into the collar 42 of the staged telescopic boot 20 snugly within the annular connector mounting opening 34 of the connector mounting end 24 disposed at the upper end of the staged telescopic boot 20. The circumferential rim 46 of the annular connector mounting opening 34 bears against the shoulder 64 of the threaded reducer 50 contemporaneously as an interior surface of the collar 42 grips tightly against the corrugated portion 66 of the reducer stem 54 causing the collar 42 of the staged telescopic boot 20 to be compressed tightly against the reducer stem 54 of the threaded reducer 50 thereby securing the staged telescopic boot 20 thereto the threaded reducer 50.

In the embodiment of the disclosure, the end clamp 80 is secured around the collar 42 of the staged telescopic boot 20 and the reducer stem 54 of the threaded reducer 50, the end clamp 80 enabling and operable to secure the removable attachment of the staged telescopic boot 20 to the threaded reducer 50.

With reference to FIGS. 1 and 2 the end clamp 80 includes a metal annular clasp configured for enabling and operable to constrict around the collar of the staged telescopic boot 20 having the reducer stem removably attached therein. The end clamp 80 can include two annular arms that are capable of retracting around the collar 42 of the staged telescopic boot 20 to secure the collar 42 of the staged telescopic boot against the reducer stem 54. The end clamp 80 can be a muffler clamp, an exhaust clamp, a v-clamp. The end clamp 80 can include a bolt to close and secure the end clamp 80.

A diameter ($D^3$) of the annular connector mounting end opening 34 of the staged telescopic boot 20 of the connector mounting end 24 is fractionally greater than a diameter ($D^1$) of the annular connector boot end opening 40 at the connector boot end 58 of the threaded reducer 50. Thereby, the staged telescopic boot 20 is coupled securely to the threaded reducer 50. In this manner, the staged telescopic boot 20 is securely coupled to the threaded reducer 50 such that the annular connector mounting opening 34 of the connector mounting end 24 of the staged telescopic boot 20 is fluidly connected to the central opening 56 of the threaded reducer 50 to provide for a continuous flow of pressurized hot water as it travels from the water faucet 200, as shown in FIGS. 4 and 5, therethrough the threaded reducer 50 there through the staged telescopic boot 20 and into a glass pipe mounted thereon. The flow of the pressurized hot water traveling from the water faucet 200 is explained in more detail below.

In another embodiment of the disclosure, the diameter ($D^2$) of the annular connector boot end opening 68 of the connector boot end 58 of the threaded reducer 50 is fractionally greater than the diameter ($D^3$) of the annular connector mounting opening 34 at the connector mounting end 24 of the staged telescopic boot 20. The shoulder 64 formed at the upper end of the reducer stem 54 and the lower end of the sleeve nut portion 52 of the threaded reducer 50 provides a limiting member such that the connector mounting end 24 of the staged telescopic boot 20 when inserted within the opening at the connector boot end of the reducer stem causes the collar 42 of the staged telescopic boot 20 to bear against an internal terminal portion of the shoulder 64 of the threaded reducer 50. In this manner, the staged telescopic boot 20 is coupled to the threaded reducer 50 such that the annular connector mounting end opening 34 of the connector mounting end 24 of the staged telescopic boot 20 is operatively fluid to the central opening 56 of the threaded reducer 50 to provide for a continuous flow of pressurized hot water as it travels from the water faucet 200 there through the threaded reducer 50 there through a hollow central channel 32 of the staged telescopic boot through an annular connector retaining opening 40 and into a glass pipe 100 mounted thereon.

In this exemplary embodiment, the reducer stem has the corrugated portion 66 to secure the threaded reducer 50 to the staged telescopic boot 20. In operation, the connector mounting end 24 of the staged telescopic boot 20 is snugly inserted within the annular connector boot end opening 68 of the reducer stem 54 of the threaded reducer 50. For a more secure coupling of the connector mounting end 24 of the staged telescopic boot 20 within the connector boot end 58 of the reducer stem 54 of the threaded reducer 50 the end clamp 80 can be used to grip and tighten around the corrugated portion 66 of the reducer stem 54 and secure the staged telescopic boot 20 surrounding at the point of connection around an annular retainer vertebra thereon as the glass pipe 100 is inserted therein the hollow channel 32 within the core 22 of the staged telescopic boot 20, the glass pipe 100 to be cleaned during the cleaning process securely vertically co-axially with the threaded reducer 50.

More particularly, the threaded reducer 50 extending from a connector mounting end 24 of the staged telescopic boot 20, includes the sleeve nut portion 52 and the reducer stem 54. The threaded reducer includes the connector faucet end 60 having an annular connector faucet end opening 70 and a connector boot end 58 having an annular connector boot end opening 68 providing a central opening 56 therebetween, the connector faucet end 60 for removably attaching to the mouth of the water faucet 200 and the connector boot end 58 for removably attaching to the connector mounting end 24 having an annular connector mounting opening 34 at a top end 24 of the staged telescopic boot 24 providing a fluid passageway having fluid communication with the central opening 56 of the threaded reducer 50 configured to be in fluid communication with the mouth of the water faucet 200 through the annular connector faucet end opening 70 for introducing pressurized hot water and configured to be in fluid communication with the staged telescopic boot 20 through the annular connector boot end opening 68 of the threaded reducer 50 mounted to the annular connector mounting opening 34 at the connector mounting end 24 of the staged telescopic boot 20.

More particularly, the staged telescopic boot 20 extending from the threaded reducer 50, the staged telescopic boot 20 comprises, the collar 42, the core 22 providing an elongated sleeve member defining the hollow central channel, the top end 24, the bottom end 26, the exterior surface 36, the interior surface 38. The top end 24 is the collar 42 providing the connector mounting end 24 for removably attaching to the connector boot end 58 of the threaded reducer 20 configured to be in fluid communication with the central opening 56 of the threaded reducer 50 through the annular connector mounting opening 34 of the staged telescopic boot 20.

For reference purposes, the staged telescopic boot 20 has a longitudinal axis "L" that lies along the longitudinal centerline of the glass pipe cleaning 10. A Cartesian coordinate system having x, y, and z axes is shown in FIG. 1, where the x-axis represents the width of the glass pipe cleaner 10, the y-axis represents the length of the glass pipe cleaner 10, and z-axis represents the height of the glass pipe cleaner 10.

The bottom end 26 is the connector retaining end 26 providing an annular connector retaining opening 40 being dimensioned to receive the mouth end portion 106 of the glass pipe 100 of varying sizes to be cleaned.

The exterior surface 36 of the staged telescopic boot 20 includes a series of stages providing a series of annular retaining vertebrae 28, each annular retaining vertebrae 28 having a related retaining step 44 providing a gripping surface for the worm drive clasp 600 orientated transversely along the longitudinal axis of the core 22 aligning in a series of consecutive annular retaining vertebrae 28 configured having a primary annular retaining vertebra 28[1] at the top end 24 of the staged telescopic boot 20 and having a terminal annular retaining vertebra 28[4] at the bottom end 26 of the staged telescopic boot 20.

The primary annular retaining vertebra 28[1] having a minimal cross-section diameter, the terminal annular retaining vertebra 28[4] having a maximum cross-section diameter, a secondary annular retaining vertebra 28[2] disposed a distance adjacent to the primary annular retaining vertebrae 28[1] having a second cross-section diameter greater than the minimal cross-section diameter of the primary annular retaining vertebra 28[1], and a tertiary annular retaining vertebra 28 disposed a distance from the secondary annular retaining vertebra 28[3] having a third cross-section diameter greater than the second cross-section diameter of the secondary annular retaining vertebrae 28[2] but less than the maximum cross-section diameter of the terminal annular retaining vertebra 28[4].

The hollow central channel 32 of the staged telescopic boot 20 extending along the longitudinal axis "L" and being dimensioned with the interior surface 38 having the series of annular insertion sleeves 48 having a related insertion stop 30, anchoring and providing a seat for the mouth end portion 106 of the glass pipe 100 including glass pipes 100 of varying cross-diameters. The series of annular insertion sleeves 48 having a related insertion stop 30, are formed consubstantially with the series of annular retaining vertebrae 28 causing each annular insertion sleeve 48 having a related insertion stop 30 to be configured orientated transversely from the inner surface 38 of the core 22 aligning in a series of consecutive annular insertion sleeves 48 each annular insertion sleeve 48 having a related insertion stop 30, configured having a primary annular insertion sleeve 48[1] disposed at the top end 24 of the staged telescopic boot 20 and having a terminal annular insertion sleeve 48[4] disposed at the bottom end 26 of the staged telescopic boot 20.

The primary annular insertion sleeve 48[1] has a minimal cross-section diameter[1], the terminal annular insertion sleeve 48[4] has a maximum cross-section diameter[4], a secondary annular insertion sleeve 48[2] disposed a distance adjacent to the primary annular insertion sleeve 48[1] has a second cross-section diameter[2] greater than the primary cross-section diameter[1] of the primary annular insertion sleeve 48[1], and a tertiary annular insertion sleeve 48[3] disposed a distance adjacent from the secondary annular insertion sleeve 48[2] having a third cross-section diameter[3] greater than the second cross-section diameter[2] of the secondary annular insertion sleeve 48[2] but less than the terminal cross-diameter[4] of the terminal annular insertion sleeve 48[4].

The end clamp 80 provides a releasable fastening means, the end clamp 80 is fastened around the collar 42 of the staged telescopic boot 20 to secure the staged telescopic boot 20 to the threaded reducer 50.

The mouth end portion 106 of the glass pipe 100 is inserted into the annular connector retaining opening 40 of the staged telescopic boot 20, the mouth end portion 106 of the glass pipe 100 including a mouth end opening 110 to an intermediary tube 108 of the glass pipe 100 configured with a limiting cross-section diameter is inserted within the annular insertion sleeve 48 seated against its related insertion stop 30 configured to receive the limiting cross-sectional diameter of the mouth end opening 110 of the glass pipe 100.

The worm drive clamp 600 including a housing 640, a locking screw 620, a flexible band 66 having a plurality of band slots 680 is fastened and tightened around the exterior surface 36 of the staged telescopic boot 20 to secure the mouth end portion 106 of the glass pipe 100 within the annular insertion sleeve 48.

The mouth end opening 110 of the intermediary tube 108 of the glass pipe 100 is in fluid communication with a loading end opening 112 of the glass pipe 100 such that the pressurized hot water will be drawn from the water faucet 200 forcefully flowing through the fluid passageway including the central opening 56 of the threaded reducer 50, through the annular connector mounting opening 34 of the staged telescopic boot 30, through the mouth end opening 110 of the glass pipe 100, and through the loading end opening 112 of the glass Pipe 100, thereby cleaning the interior surfaces of the walls of the intermediate tube 108 of glass pipe 100 in response to the pressurized hot water flowing forcefully through the intermediary tube 108 of the glass pipe 100.

Figure 3B:
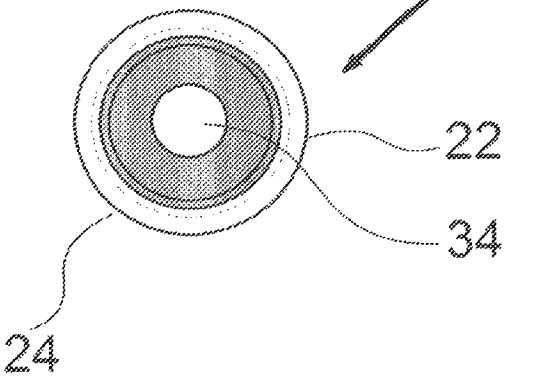
FIG. 3B is a top plan view of the glass pipe cleaner, in accordance with the embodiment of the disclosure.
Figure 3A:
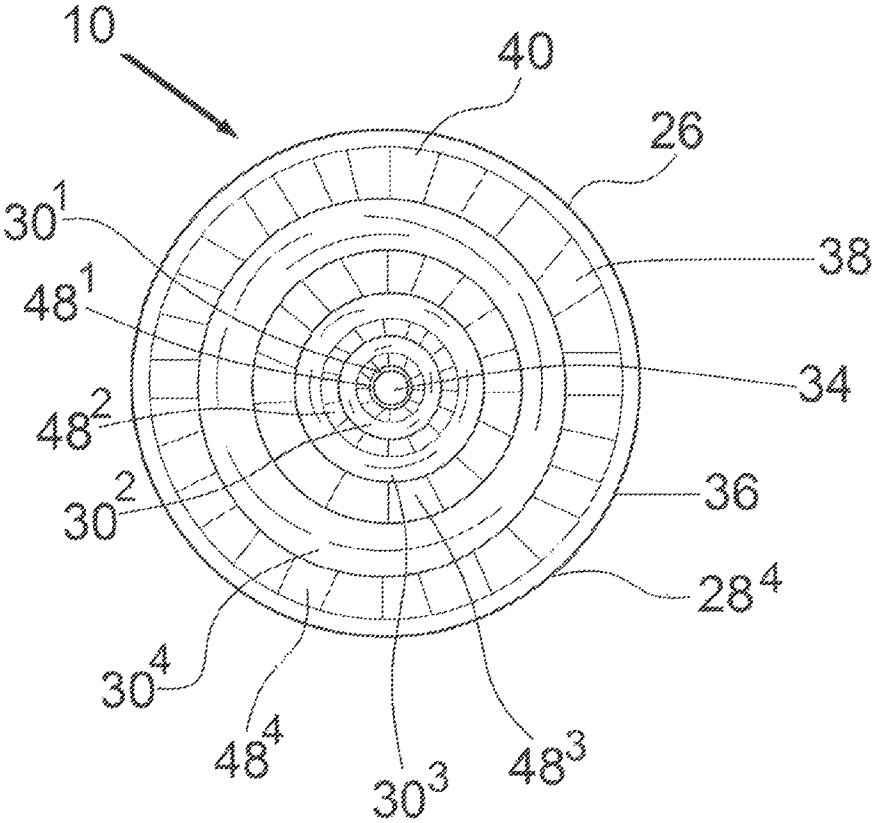
FIG. 3A is a bottom plan view of the glass pipe cleaner, in accordance with the embodiment of the disclosure.

FIG. 1 represents a perspective view of the glass pipe cleaner 10 including the staged telescopic boot 20. FIG. 2 represents an isometric view of the staged telescopic boot at 20 according to the embodiment of the disclosure. FIG. 3A is a top plan view of the bottom of the glass pipe cleaner 10 which is consubstantial with the bottom of the staged telescopic boot 20. The staged telescopic boot 20 provides a repositionable staged telescopic boot 20 having the annular connector retainer opening 40 to the hollow channel 32 operative to receive a first end of a glass pipe 100. The staged telescopic boot 20 provides for the fitting of the threaded reducer 50 at the connector mounting end 24 and the insertion of the glass pipe 200 to be cleaned within the annular connector retainer end opening 40 of the connector retainer end 26 of the staged telescopic boot 20.

The staged telescopic boot 20 is secured around the circumferential surface of the glass pipe 200 by means of a worm drive clamp 600 wherein the worm drive clamp includes a locking screw 62. The glass pipe 200 can be held in such assembled relation by means of annular retainer vertebrae 28 configured with varying cross-sections coaxially arranged along the longitudinal axis of the glass pipe cleaner 10. As shown in FIG. 3A, the interior configuration of the annular retainer vertebrae 28 thereof provide a limitation means, an annular insertion sleeve and insertion stop 30 of varying diameters for glass pipes 200 of varying diameters.

The staged telescopic boot 20 includes a core 22 providing an elongated sleeve member including a top end 24 and a bottom end 26 and an exterior surface 36 and an interior surface 38. The top end 24 is a connector mounting end 24 having the collar 42 providing an annular connector mounting end opening 34 is the end that will be removably attached to the threaded reducer 50 to yield a glass pipe cleaner 10. The bottom end 26 is a connector retaining end 26 providing an annular connector retaining opening 40 which is the end that will receive the top open end of the glass pipe 200 to be cleaned.

The hollow central channel 32 runs along the longitudinal axis "L" through the core 22 from the connector mounting end 24 therethrough the connector retaining end 26 which is fluidly communicative with the central opening 56 of the threaded reducer 50. The hollow central channel 32 is tapered in generally a cone shape including a variable cross-section that is greater at the bottom end 26 than the top end 24. The connector mounting end 24 having the annular connector mounting opening 34 is configured to releasably attach to the threaded reducer 50. The connector retaining end 26 having the annular connector retaining opening 40 is configured for inserting a variety of sizes of glass pipes 200 therewithin the annular connector retaining opening 40 at the connector retaining end 26 so that the glass pipe 100 can be cleaned.

The staged telescopic boot 20 is repositionable. Repositionable staged telescopic boot 20 means generally that the staged telescopic boot 20 can be bent or flexed multiple times from its original position, which is a cone shape having a series of annular retainer vertebrae 28, to a second position, which, generally, is compressed with the force of the worm drive clamp 600, and then readily returns back to its original position when the worm drive clamp 600 is removed.

Each of an annular retainer vertebra 28 of the series of the annular retainer vertebrae 28 extends perpendicularly from the core 22 of the staged telescopic boot 20 positioned in a progression from the connector mounting end 24 to the connector retaining end 26 to form a series of annular retainer vertebrae 28 providing a retaining surface co-axial with the core 22 exterior surface 36 therebetween each annular retainer vertebrae 28 to secure the worm drive clamp 600 around the staged telescopic boot 20 as the stage telescopic boot 20 anchors the glass pipe 200 therewithin to be cleaned during the cleaning process.

Each of the annular retainer vertebra 28 are molded in place to form an annular retainer vertebral column along the exterior surface 36 of the core 22 of the staged telescopic boot 20. The series of annular retainer vertebrae 28 provide a series of cross-sectional diameters of increasing diameters extending from the top end 24 of the staged telescopic boot 20 to the bottom end 26 of the telescopic boot 20 as shown in FIGS. 1-5.

The staged telescopic boot 20 includes a primary annular retainer vertebra $\mathbf{28}^1$ having a primary cross-sectional diameter at the top end 24 of the staged telescopic boot 20 and a terminal annular retainer vertebra $\mathbf{28}^4$ having a terminal cross-sectional diameter at the bottom end 26 of the staged telescopic boot 20, the primary cross-sectional diameter is less than the terminal cross-sectional diameter thereby each of the consecutive annular retainer vertebrae therebetween the primary annular retainer vertebra $\mathbf{28}^1$ and the terminal annular retainer vertebra $\mathbf{28}^4$ increase variably in cross-sectional diameter along the longitudinal axis "L" from the primary annular vertebra $\mathbf{28}^1$ to the terminal annular vertebra $\mathbf{28}^4$.

The annular retainer vertebrae 28 are formed integrally disposed on the exterior surface 36 of the staged telescopic boot 20. The annular retainer vertebrae 28 are each formed integrally extending perpendicular from the core 22 of the staged telescopic boot 20. The core 22 has an inner surface providing a series of annular insertion sleeves 48 and a series of retaining stops 28 consubstantial with the series of annular retainer vertebrae 28 extending within the hollow channel of the core 22 to provide a series of annular insertion sleeves 48 and insertion stops 30 for anchoring the top opening of an outside diameter of a variety of glass pipes 100 of variable diameters of glass pipes 100 when the glass pipe 100 is inserted therewithin the hollow central channel 32 of the staged telescopic boot 20.

The staged telescopic boot 20 can include one or more annular retainer vertebrae 28. In the exemplary embodiment of the disclosure, the staged telescopic boot 20 includes four annular retainer vertebrae 28, as shown in FIGS. 1-5.

The series of annular retainer vertebrae 28 form a corresponding series of insertion sleeves 48 within the interior of the core of the staged telescopic boot 20 wherein the hollow channel 32 of the staged telescopic boot 20 provides an annular opening for each annular insertion sleeve 48 further providing fluid communication with the central opening 56 of the threaded reducer 50. The series of insertion sleeves 48 include increasing cross-sectional diameters$^3$ corresponding to the series of the annular retainer vertebrae 28 cross-sectional diameters. Each of the insertion sleeves 48 includes a cross-sectional diameter$^3$ fractionally less than the cross-sectional diameter of its corresponding retainer vertebra 28. The difference of the cross-sectional diameters of the retainer vertebra 28 cross-sectional diameter and the cross-sectional diameter$^3$ of each the insertion sleeve 48 is the measure allotted for thickness of the material, for example, rubber or silicone that the staged telescopic boot 20 is manufactured there from.

Each of the annular insertion sleeve 48 of the series of annular insertion sleeves 48 is limited by its corresponding insertion stop 30 forming a series of insertion stops 30. The series of insertion stops 28 include increasing diameters having a primary insertion stop $\mathbf{28}^1$ having a primary cross-sectional diameter$^2$ at the top end 24 of the staged telescopic boot 20 and a terminal insertion stop $\mathbf{28}^4$ having a terminal cross-sectional diameter$^2$ proximate to the bottom end 26 of the staged telescopic boot 20. The terminal cross-sectional diameter$^2$ is greater than the primary cross-sectional diameter$^2$ thereby each of the consecutive insertion stops 28 therebetween the primary insertion stop $\mathbf{28}^1$ and the terminal annular retainer stop $\mathbf{28}^4$ increase variably in cross-sectional diameter along the longitudinal axis from the primary annular retainer stop $\mathbf{28}^1$ to the terminal annular retainer stop $\mathbf{28}^4$.

In operation, the first end of the glass pipe 100, the first end having the opening for the user's mouth, to be cleaned is inserted into the connector retaining end 26 of the staged telescopic boot 20 of the glass pipe cleaner 10. The glass pipe 100 is inserted therein until the first end of the glass pipe 100 bears against the insertion stop 30 having a corresponding cross-sectional diameter to the first end cross sectional diameter of the glass pipe 100 providing for the first end of the glass pipe 100 to bear against that insertion stop 30 having the annular insertion sleeve 48, and the peripheral surface of the glass tube 100 to bear against the annular insertion sleeve 48. The glass pipe 100 is secured within the annular insertion sleeve 48 of the staged telescopic boot 20 by means of the worm drive clamp 600.

The worm drive clamp 600 is tightened around the staged telescopic boot 20 to secure the top portion of the glass pipe 100 against the insertion stop 28 and therewithin the annular insertion sleeve 48. In this manner the top opening of the glass pipe 100 is fluidly communicative to the hollow channel 32 of the staged telescopic boot 20 and thereby fluidly communicative to the central opening 56 of the threaded reducer 50 removably attached to the water faucet 200 and, thereby, consequentially fluidly communicative to the mouth of the water faucet 200 providing the source of the forceful flow of pressurized hot water to clean the glass pipe 100.

The series of annular retainer vertebrae 48 are configured with varying cross-section diameters to provide a variable insertion stops 30 and annular insertion sleeves 48 of varying cross-sectional diameters for glass pipes 100 of varying diameters which are inserted therewithin the staged telescopic boot of the glass pipe cleaning 10 during the cleaning process. Each annular retainer vertebra 28 of the series of annular retainer vertebrae 28 having a configured variable cross-section diameter can provide the insertion stop 30 against which the first end of the glass pipe 100 bears against to be retained by its related annular insertion sleeve 48. By way of explanation, the primary annular retainer vertabra $\mathbf{28}^1$ can provide a minimal insertion stop 30 having the a minimum primary cross-section diameter, against which the first end of the glass pipe 100 of a corresponding minimum cross-section diameter bears against the insertion stop limited by the minimum cross-section diameter of the first end of the glass pipe 100. A terminal annual retainer vertebra 28[4] can provide a maximum insertion stop 30 having the maximum terminal cross-section diameter, against which the first end of the glass pipe 100 of a maximum corresponding cross-section diameter bears against the insertion stop limited by the maximum cross-section diameter of the first end of the glass pipe 100.

The configuration of the staged telescopic boot 20 having varying cross-section diameters of each of the annular retaining vertebra 28 of the series of annular retaining vertebra 28, having the largest cross-sectional diameter at the bottom end 26 of the staged telescopic boot 20 of the glass pipe cleaner 10, also, has the advantage which provides for easy removal of the glass pipe 100 from the staged telescopic boot 20 after the cleaning process of the glass pipe 100 than to remove a glass pipe 100 from a boot that has a constant cross-section.

The annular retainer vertebrae 28, also, provide a reinforcement. The staged telescopic boot 10 having the core 22, the series of annular retainer vertebrae 28 including the series of annular insertion sleeves 48 and the insertion stops 30 are manufactured with rubber. In another embodiment, the staged telescopic boot 10 having the core 22 annular retainer vertebrae 28 including the annular insertion sleeves 48 and the insertion stops 30 are manufactured with silicone. Thereby, the core, the series of annular retainer vertebrae 28 including the series of annular insertion sleeves and the insertion stops 22 provide a gripping feature that provide for a better grasp of the glass pipe 100 when the glass pipe 100 is inserted therewithin the annular insertion sleeve 48 of the staged telescopic boot 20 during the cleaning process. In addition, the rubber or silicone core 22 provides for better cinching by the worm drive clamp 600 against the core 22 when the worm drive clamp 600 cinches around the staged telescopic boot 20 of the glass pipe cleaner 10 when the glass pipe 100 is inserted therewithin the staged telescopic boot 20 during the cleaning process.

The staged telescopic boot 20 of the present disclosure can be manufactured from rubber, silicone, or a variety of elastomeric polymers. The staged telescopic boot 20 can be manufactured by various techniques. Suitable manufacturing techniques include injection molding.

Referring to FIG. 1-5, and more particularly to FIGS. 1 and 2, the worm drive clamp 600 is a conventional worm drive clamp 600. The worm drive clamp 60 is commercially available in home improvement stores, or hardware stores.

The worm drive clamp 600 provides a retainer means to secure and compress the staged telescopic boot 20 around a top portion of the glass pipe 100 during the cleaning process of the glass pipe 100 according to the embodiment of the disclosure. The worm drive clamp 600 ensures that the glass pipe 60 does not slip from being seated within the annular insertion sleeve 48 within the staged telescopic boot 20. The worm drive clamp 600 provides a means for clamping, tightening, and/or release of the staged telescopic boot 20 surrounding the glass pipe 100 which is inserted therein the annular insertion sleeve 48 within the interior of the core 22 of the staged telescopic boot 20, the glass pipe 100 to be cleaned during the cleaning process.

The worm drive clamp 600 comprises, as known to those persons skilled in the art, a housing 620, a lock screw 640 serving as a tightening means, a flexible band 660 having band slits 680 passing therethrough the lock screw 640. The flexible band 660 provides a means to surround the exterior surface 36 of the core 22 of the staged telescopic boot 20 to be clamped and tightened around the staged telescopic boot 20 when the glass pipe 100 to be cleaned is inserted therein the annular insertion sleeve 48 within the interior of the core 22 of the staged telescopic boot 20 of the glass pipe cleaner 10.

As shown in FIGS. 4 and 5, the locking screw 640 is orientated approximately parallel to the longitudinal axis of the staged telescopic boot 20 including the inserted glass pipe 100 being clamped. As shown in FIGS. 1 and 2, the flexible band 660 includes a plurality of substantially transverse band slots 680, shown as 680 and 700. The flexible band 660 includes a second layer of flexible band 66 that passes through a bottom slotted region of the housing 62 such that the slots 680 and 700 are operably engaged with a locking key mounted therein the housing 620. As the locking screw 640 is rotated in a clockwise direction, the flexible ban 66 including the band slots proximate to 680 will, in turn be driven through the housing by means of a gear tooth until the band slot exits on the same side as slot 700, so as to decrease the circumference of the flexible band 660 and tighten the worm drive clamp 600 around the staged telescopic boot 20 retaining and clamping the glass pipe 100 inserted therewithin. Conversely, when the locking screw 640 is rotated in a counter-clockwise direction so as to result in an increase in the circumference of the flexible band 660 and corresponding loosening of the worm drive clamp 600 around the staged telescopic boot 20 now releasing and unclamping the glass pipe 100 inserted therewithin after the glass pipe 100 is cleaned.

The worm drive clamp 600 may be manufactured with stainless steel or carbon steel. The worm drive clamp 600 can be provided in a variety of diameters including the range of 5/16 inch to about 6.00 inches.

As known to persons skilled in the art, and as a reference, in general, the glass pipe 100 includes a tubular body member 102 constructed entirely of heat resistant glass material. The glass pipe 100 has an integrally machined intermediary tube 108 having a hollow channel disposed within the tubular body 102. The glass pipe 100 includes a loading end portion 104 having a loading end opening 112; and a mouth end portion 106 having a mouth end opening 110. The intermediary tube extends through the tubular body member 102 from the loading end portion 104 to the mouth end portion 106. The loading end portion 104 includes an annular beveled surface that extends between the outer surface of the tubular member 102 and the intermediary tube 108. An inner annular ring is formed in the tubular body member 102 fluidly connected to the intermediary tube 108 proximal the loading end portion. The annular ring defines a constricted passage or venture and separates the intermediary tube 108 into a smoke chamber and a loading chamber. The smoke chamber and loading chambers are fluidly connected to each other through the hollow conduit of the intermediary tube 108. The mouth end portion 106 having the mouth end opening 110 and the loading end portion 104 having the loading end opening 112 are fluidly connected to each other through the hollow conduit of the intermediary tube 108.

In this manner, when the glass pipe 100 is anchored within the annular insertion sleeve 48 within the staged telescopic boot 20 of the glass pipe cleaner 10 the mouth end opening 110 is fluidly connected to the annular connector mounting opening 34 of the stage telescopic boot 20 where the annular connector mounting opening 34 is fluidly connected to the central opening 56 of the threaded reducer 50, where the central opening 56 of the threaded reducer 50 is fluidly connected to the mouth of the water faucet 200. In this manner the pressurized hot water can flow with extreme force from the water faucet through the central opening 56 of the threaded reducer 50 through the annular connector mounting opening 34 of the staged telescopic boot 20 therethrough the mouth end opening 110 of the glass pipe 100 and therethrough the loading end opening 112 of the glass pipe 100. The pressurized hot water carries the dirty waste water out of the intermediary tube 108 of the glass pipe 100 to be discarded in a sink or receptacle or waste bag 120 for disposal.

It is on the interior surfaces of the walls of the intermediary tube 108 that the residual deposits from the smoked substance accumulate. As the smoke travels through the intermediary tube 108, oils—akin to creosote—are released into the air inside the intermediary tube 108. These creosote oils stick to the interior surface of the intermediary tube 108. Over time, the interior surfaces of the walls of the intermediary tube 108 collect layers of creosote oily deposits, residue, debris, and other smoke particulate deposits. These creosote oily deposits, and other residues, carry an undesirable scent and are visually displeasing.

In operation, with the glass pipe cleaner 10 mounted to the water faucet 200 head 202 by means of the threaded reducer 50, a user inserts the mouth end portion 106 of the glass pipe cleaner 10 into the annular connector retainer opening 40 at the connector retaining end 26 of the staged telescopic boot 20. The user pushes the mouth end portion 106 of the glass pipe into the channel of the staged telescopic boot 20 until the mouth end portion 106 bears against the insertion stop 30 of approximate cross-section diameter of the cross-section diameter of the mouth end portion 106 of the glass pipe 100 causing the mouth end portion 106 of the glass pipe 100 to be seated snugly within the annular insertion sleeve 48 related to the insertion stop 30 of the staged telescopic boot 20. Next the user cinches and secures the staged telescopic boot 20 around the mouth end portion 106 of the glass pipe 100 by means of the worm drive clamp 60 by turning and tightening the locking screw 62 of the worm drive clamp 60.

In this manner, the mouth end opening 110 of the mouth end portion 106 of the glass pipe 100 is fluidly connected to the mouth of the water faucet 200 by way of the mouth end portion 106 of the glass pipe 100 fluidly connected to the annular connector mounting opening 34 of the stage telescopic boot 20 where the annular connector mounting opening 34 is fluidly connected to the central opening 56 of the threaded reducer 50, where the central opening 56 of the threaded reducer 50 is fluidly connected to the mouth of the water faucet 200. In this manner the pressurized hot water can flow with extreme force from the water faucet through the central opening 56 of the threaded reducer 50 through the annular connector mounting opening 34 of the staged telescopic boot 20 therethrough the mouth end opening 110 of the glass pipe 100 and therethrough the loading end opening 112 of the glass pipe 100.

To install the glass pipe cleaner 10 onto the water faucet 200, the annular sleeve 62 of the connector faucet end 62 having the annular connector faucet opening 70 of the sleeve nut portion 52 of the threaded reducer 50 is inserted over the mouth of the water faucet 200. The threaded reducer 50 is rotated to facilitate engaging the interior threads of the central opening 56 of the threaded reducer 50 with the exterior threads of the head 202 of the water faucet 200 thereby securing the glass pipe cleaner 10 thereon the water faucet 200.

In operation, a user turns on a hot water component attached to the water faucet 200 head 201 enabling the hot water to flow through the water faucet head. The flow of hot water is pressurized by the threaded reducer 50 mounted thereon the water faucet 200 head 202 enabling the flow of hot water to pass through the glass pipe 100 with extreme force. The force of the pressurized hot water is operative and enabling for the removal of deposits that have accumulated on surfaces of interior walls intermediary tube 108 of the glass pipe 100. Debris and residuals formed from the removed deposits are carried away by the force of the hot water through the loading end opening 112 at the loading end portion 104 of the glass pipe 100 and discarded in a disposable receptacle or in a sink receptacle beneath the water faucet 200 head 202. The user thus has effectively and safely cleaned the glass pipe 100 using only pressurized hot water as the abluent.

Regarding a method 400 of use of the glass pipe cleaner 10 the glass pipe cleaner 10 is used to remove creosote oils that stick to the interior surfaces of the walls of the intermediary tube 108 of the glass pipe 100 and discard oily deposits and smoke particulate accumulated on surfaces of interior walls of the a glass pipe. The method 400 of use of the glass pipe cleaner 10 includes a first step 401 providing a clean pipe cleaner 10, comprising a threaded reducer 50, a staged telescopic boot 20, and end clamp 80, as disclosed in detail above, for use with a conventional water faucet 200. The second step 402 includes removably attaching the glass pipe cleaner 10 to a threaded mouth of the water faucet 200 by threadably engaging the threaded reducer 50 to a threaded mouth of water faucet 200. As shown in FIG. 4 the glass pipe cleaner 10 is mounted to the water faucet 200 by threadably engaging the opposed threaded surfaces of the threaded reducer 50 and the water faucet 200. The threaded reducer 50 is configured for mounting onto a water faucet 200 head 202. The threaded reducer 50 includes integrally machined threads that are configured to be opposed to integrally machined threads of the water faucet 200 head 202 such that when the threaded reducer 50 is inserted into the threaded opening of the mouth of the water faucet 200 head 202 the threaded reducer 50 and the water faucet 200 head 202 become removably attached to each other upon rotating the threaded reducer 50 engaged with the threaded opening of the mouth of the water faucet 200 head 202. Thereby, the threaded reducer 50 is operative and enabling for mounting the glass pipe cleaner 10 onto the conventional water faucet 200 by engaging and rotating together the opposed threaded ends.

A third step 403 of the method 400 includes inserting the mouth end portion of the glass pipe into the annular retaining opening 40 of the staged telescopic boot 20.

A fourth step 404 of the method 400 includes securing the mouth end portion 106 of the glass pipe 100 within the annular insertion sleeve 48 causing the mouth end portion 106 of the glass pipe 100 to be seated against the insertion stop 30 such that the mouth end opening 106 of the glass pipe 100 is fluidly communicative with the annular connector mounting opening 34 of the staged telescopic boot 20

A fifth step 405 of the method 400 includes securing the mouth end portion 106 of the glass pipe 100 inserted therein the staged telescopic boot 20 by securing and tightening the worm drive clamp 60 around the exterior surface 36 of the staged telescopic boot surrounding the mouth end portion 106 of the glass pipe 100.

A sixth step 406 a user turning on the hot water component attached to the water faucet 200 head 202 enabling the hot water to flow through the water faucet 200 head 202, as shown in FIG. 5. The flow of hot water is pressurized by the threaded reducer 50 mounted thereon the water faucet 200 head 202 enabling the flow of hot water to pass through the glass pipe 100 with extreme force. The force of the pressurized hot water is operative and enabling for the removal of deposits that have accumulated on surfaces of interior walls of the intermediary tube 108 glass pipe 100.

Debris and residuals formed from the removed deposits are carried away by the force of the hot water through the loading end opening 112 of the glass pipe 100 and discarded in a sink beneath the water faucet 200 head 202 or into the waste bag 120. The user thus has effectively and safely cleaned the glass pipe using only hot water as the abluent.

The seventh step 407 of the method 400 includes removing the glass pipe from the annular insertion sleeve of the staged telescopic boot 20;

The eighth step 408 of the method 400 includes releasing the glass pipe cleaner 10 from the mouth of the water faucet 200 by means of threadably disengaging the threaded reducer 50 from the mouth of the water faucet 200 and thereby removing the glass pipe cleaner 100 from the water faucet 200 head 202

The eighth step 408 of the method 400 includes reverse turning of the engaged threads of the threaded reducer 50 and the interior threads of the mouth of the water faucet 200 head 202 thereby releasing the glass pipe cleaner 10 by means of the threaded reducer 50 from the water faucet 200 head 202.

As shown in FIG. 5, in another embodiment of the disclosure, the glass pipe cleaner 100 may be used in conjunction with a waste bag 120. The waste bag 120 permits the present disclosure to be easily practiced with the waste bag 120 for convenient disposal of debris and residue collected during cleaning of the glass pipe 100 or water pipe.

The waste bag 120 comprises an expandable bladder extending from an opening having a slidable closing means. The expandable bladder includes a drainage hole. The waste bag 120 can be a plastic bag, for example, a disposable plastic baggy.

The waste bag 120, as shown in FIG. 5, is covered over the glass pipe cleaner 10 having the glass pipe 10 inserted therein and after the glass pipe cleaner 10 is mounted to the water faucet 200 by means of the threaded reducer 50. The waste bag 120 is manually secured over the glass pipe cleaner 10 having the glass pipe 100 mounted thereon such that the waste bag 120 encompasses the glass pipe cleaner 10 during the process of cleaning the glass pipe 100.

A drain hole 122 is disposed at the base of the expandable waste bag 120 wherein the drain hole 122 allows the dirty waste water to flow therethrough leaving behind the scraped residue and debris that has been removed from the intermediary tube 108 behind in the waste bag 120. In operation, the debris and residue exiting the glass pipe 100 is contained in the waste bag 120 as dirty hot water passes through the drain hole 122 at the base of the waste bag 120. The dirty hot water exits the waste bag 120 in a controlled manner for disposal through the underlying sink or receptacle. The debris and residue can be discarded in an environmental friendly manner along within the waste bag 120.

The waste bag 120 can be manufactured from biodegradable material.

In an embodiment of the disclosure, the glass pipe cleaner 10 includes a flexible hose 300 to clean a water pipe. A length of the flexible hose 300 having a hollow interior is utilized to clean water pipes, colloquially referred to as "bongs". The flexible hose 300 includes a connector end and a delivery end having opposing openings, a connector opening and a delivery opening. The length of the flexible hose 300 is configured to allow the delivery opening reach the bottom interior surface of the water pipe causing the bottom interior surfaces to be cleaned.

The diameter of the connector end and the delivery end of the flexible hose 300 are each configured to easily be inserted within the staged telescopic boot 20 and into the opening of the water pipe. The diameter ($D^3$) of the connector opening is fractionally less than the diameter ($D^1$) of the central mouth of the sleeve nut portion 52 of the threaded reducer 50 to ensure a seal of the connector end of the flexible hose 300 bearing against the threaded reducer 50 such that the connector opening of the flexible hose 300 is fluidly connected with the mouth of the water faucet 200 causing the flow of the pressurized hot water to the bottom of the water pipe.

The delivery end of the flexible hose 300 having the delivery opening is inserted into the opening of the water pipe where the water pipe is secured by the staged telescopic boot 20. In operation, the pressurized hot water flows through the water faucet 200 head 202 through the flexible hose 300 secured by the threaded reducer 50 providing the flow of pressurized hot water against the interior surfaces of the water pipe.

In operation, the user turns on the hot water component attached to the water faucet 200 head 202 to run through the water faucet 200 attached to the sink. The hot water is pressurized by the threaded reducer 50 and flows through the flexible hose 300 and floods interior portions of the water pipe with extreme force. The force of the pressurized hot water is of a strength enabling and operable to remove deposits from the interior walls of the interior portions of the water pipe. The dirty water flows carrying the removed deposits and debris out of a second end of the water pipe and into the user's sink for easy disposal.

Additional modifications and improvements of the present disclosure of the invention may also be apparent to those of ordinary skill in the art. Thus, the particular combination of parts and steps described and illustrated herein is intended to serve as limitations of alternative devices and methods within the spirit and scope of the invention. Accordingly, it is intended by the appended claims, to cover all modifications of the invention which fall within the true spirit of the scope of the invention.

What is claimed is:

1. A glass pipe cleaner for use with a water faucet for introducing hot water to a glass pipe to cause the glass pipe to be cleaned, the glass pipe cleaner comprising the combination of:

a threaded reducer;

a staged telescopic boot;

an end clamp;

a worm drive clamp;

the threaded reducer extending from a connector mounting end of the staged telescopic boot, includes a sleeve nut portion and a reducer stem, the threaded reducer includes a connector faucet end having an annular connector faucet end opening and a connector boot end having an annular connector boot end opening providing a central opening therebetween, the connector faucet end for removably attaching to a mouth of the water faucet and the connector boot end for removably attaching to the connector mounting end having an annular connector mounting opening at a top end of the staged telescopic boot providing a fluid passageway having fluid communication with the central opening of the threaded reducer configured to be in fluid communication with the mouth of the water faucet through the annular connector faucet end opening for introducing pressurized hot water and configured to be in fluid communication with the staged telescopic boot through the annular connector boot end opening of the threaded reducer mounted to the annular connector mounting opening at the connector mounting end of the staged telescopic boot;

the staged telescopic boot extending from the threaded reducer, the staged telescopic boot comprising:

a collar, a core providing an elongated sleeve member defining a hollow central channel, a top end, a bottom end, an exterior surface, an interior surface;

wherein the top end is the collar providing the connector mounting end for removably attaching to the connector boot end of the threaded reducer configured to be in fluid communication with the central opening of the threaded reducer through the annular connector mounting opening of the staged telescopic boot;

wherein the bottom end is a connector retaining end providing an annular connector retaining opening being dimensioned to receive a mouth end portion of the glass pipe of varying sizes to be cleaned;

wherein the exterior surface includes a series of stages providing a series of annular retaining vertebrae, each annular retaining vertebrae having a related retaining step providing a gripping surface for the worm drive clasp, each of the annular retaining vertebrae of the series of the annular retaining vertebrae each orientated transversely along a longitudinal axis of the core aligning in a series of consecutive annular retaining vertebrae configured having a primary annular retaining vertebrae at the top end of the staged telescopic boot and having a terminal annular retaining vertebrae at the bottom end of the staged telescopic boot, the primary annular retaining vertebrae having a minimal cross-section diameter, the terminal annular retaining vertebrae having a maximum cross-section diameter, a secondary annular retaining vertebrae disposed a distance adjacent to the primary annular retaining vertebrae having a second cross-section diameter greater than the minimal cross-section diameter of the primary annular retaining vertebrae, and a tertiary annular retaining vertebrae disposed a distance from the secondary annular retaining vertebrae having a third cross-section diameter greater than the second cross-section diameter of the secondary annular retaining vertebrae but less than the maximum cross-section diameter of the terminal annular retaining vertebrae;

wherein the hollow central channel extending along the longitudinal axis and being dimensioned with an interior surface having a series of annular insertion sleeves having a related insertion stop, anchoring and providing a seat for the mouth end portion of the glass pipe of varying cross-diameters, formed consubstantially with the series of annular retaining vertebrae causing each annular insertion sleeve having the related insertion stop to be configured orientated transversely from the inner surface of the core aligning in a series of consecutive annular insertion sleeves each annular insertion sleeve having the related insertion stop, configured having a primary annular insertion sleeve disposed at the top end of the staged telescopic boot and having a terminal annular insertion sleeve disposed at the bottom end of the staged telescopic boot, the primary annular insertion sleeve having a minimal cross-section diameter$^1$, the terminal annular insertion sleeve having a maximum cross-section diameter$^4$, a secondary annular insertion sleeve disposed a distance adjacent to the primary annular insertion sleeve having a second cross-section diameter$^2$ greater than the minimal cross-section diameter$^1$ of the primary annular insertion sleeve, and a tertiary annular insertion sleeve disposed a distance adjacent from the secondary annular insertion sleeve having a third cross-section diameter$^3$ greater than the second cross-section diameter$^2$ of the secondary annular insertion sleeve but less than the maximum cross-section diameter$^4$ of the terminal annular insertion sleeve;

wherein the end clamp provides a releasable fastening means, the end clamp is fastened around the collar of the staged telescopic boot to secure the staged telescopic boot to the threaded reducer;

wherein the mouth end portion of the glass pipe is inserted into the annular connector retaining opening of the staged telescopic boot, the mouth end portion including a mouth end opening to an intermediary tube of the glass pipe configured with a limiting cross-section diameter is inserted within the annular insertion sleeve seated against its related insertion stop configured to receive the limiting cross-sectional diameter of the mouth end opening of the glass pipe;

wherein the worm drive clamp including a housing, a locking screw, a flexible band having a plurality of band slots is fastened and tightened around the exterior surface of the staged telescopic boot to secure the mouth end portion of the glass pipe within the annular insertion sleeve; and wherein the mouth end opening of the intermediary tube of the glass pipe is in fluid communication with a loading end opening of the glass pipe such that the pressurized hot water will be drawn from the water faucet forcefully flowing through the central opening of the threaded reducer, through the annular connector mounting opening of the staged telescopic boot, through the mouth end opening of the glass pipe, and through the loading end opening of the glass pipe, thereby cleaning interior surfaces of walls of the intermediary tube of the glass pipe in response to the pressurized hot water flowing forcefully through the intermediary tube glass pipe.

2. The glass pipe cleaner, according to claim 1, wherein the staged telescopic boot is repositionable such that the staged telescopic boot can be bent or flexed multiple times from its original position to a second position, which, generally, is compressed with the force of the worm drive clamp, and then readily returns back to its original position when the worm drive clamp is removed.

3. The glass pipe cleaner, according to claim 1, wherein the staged telescopic boot is manufactured from any one of the group comprising, rubber, silicone or elastomeric polymers.

4. The glass pipe cleaner, according to claim 1, wherein the sleeve nut portion of the threaded reducer includes integrally machined interior threads disposed on an interior surface of the annular connector faucet end opening of the connector faucet end, and integrally machined exterior threads disposed on an exterior surface of an annular sleeve of the connector faucet end providing use of the glass pipe cleaner universally with a variety of water faucets found conventionally in homes.

5. The glass pipe cleaner, according to claim 1, further including a waste bag, the waste bag comprising an expandable bladder extending from a resealable opening, and a drainage hole providing a disposable receptacle to discard residual waste collected after cleaning the glass pipe.

6. The glass pipe cleaner, according to claim 1, further including a flexible tubing for cleaning a water pipe.

* * * * *